United States Patent [19]

Larsen

[11] 4,079,583

[45] Mar. 21, 1978

[54] ELECTRICAL CHESS CLOCK

[76] Inventor: Carl Ib Peder Larsen, Fasanvaenget 5, 4200 Slagelse, Denmark

[21] Appl. No.: 711,289

[22] Filed: Aug. 3, 1976

[51] Int. Cl.[2] ..... G04F 8/00

[52] U.S. Cl. ..... 58/39.5; 58/145 D

[58] Field of Search ..... 58/39.5, 23 R, 50 R, 58/145 R, 145 D; 273/131 AB, 148 R, 136 A

[56] References Cited

U.S. PATENT DOCUMENTS

| | | | |
|---|---|---|---|
| 3,662,535 | 5/1972 | Hedrick et al. | 58/39.5 |
| 3,698,180 | 10/1972 | Klein | 58/145 D |
| 3,878,675 | 4/1975 | Prociuk | 58/145 D |
| 3,961,473 | 6/1976 | Hung | 58/145 D |

FOREIGN PATENT DOCUMENTS

| | | |
|---|---|---|
| 2,277,605 | 2/1976 | France. |

*Primary Examiner*—Robert K. Schaefer
*Assistant Examiner*—Vit W. Miska
*Attorney, Agent, or Firm*—Fleit & Jacobson

[57] ABSTRACT

The invention relates to an electrical chess clock comprising a pair of time measuring circuits each having a digital time display device. The time measuring circuits are driven by a common pulse source which may alternately be connected to the time measuring circuits by means of a switching circuit being operated by the players. The digits of the time display device which normally indicates minutes may in certain periods of time, for example during the last minute of each hour, be shifted to indicate seconds. It is then sufficient that each time display device contains three digits.

9 Claims, 3 Drawing Figures

ELECTRICAL CHESS CLOCK

BACKGROUND OF THE INVENTION

1. Field of the Invention

The present invention relates to a chess clock A chess clock which is used for registration of the total time each of two chess players is using for thinking over the moves, normally comprises two separate clock units which may alternately be started and stopped by means of a manually operatable change-over mechanism.

2. Description of Prior Art.

The known chess clocks generally consist of two separate mechanical clocks which by means of a rocking lever system influencing the function of the balance of each of these clocks, may be operated in such a manner that one of the clocks is started at the same time as the other clock is stopped, and vice versa. When one of the players (for example white) has made a move he stops his clock by depressing the rocking lever. Thereby the clock of the opponent (for example black) is simultaneously being started, and when the opponent has made a move he depresses the rocking lever and thereby stops his own clock and starts the other clock, etc. The known chess clocks are provided with a so-called "wing" which during the last minutes before the clock passes the hour is lifted up by the minute hand and then falls down again at the moment where the minute hand passes the hour. Chess is normally played according to rules prescribing that the players must have made a certain number of moves within a predetermined period of time, or that the total time of thinking over the moves may not exceed a certain maximum limit for the whole game. In order to utilize the signalling function obtainable by means of the said wing it is normal to preset the clock before the start of a game to such a time that the prescribed total maximum time for thinking over or the said predetermined period of time expires exactly by passing the hour. Thus, it is usual to preset the clock at 30 minutes in chess games where the rules prescribe that the first 40 moves must be made within 2½ hours. In case of "blitz-game" where the total time of thinking over is normally only 5 minutes for each of the two players, the clocks are preset at 55 minutes so that the five minutes for the total game have expired when the wind falls by passing the hour. A few types of the mechanical chess clocks are also provided with a counter for registering the number of moves which have been made.

As mentioned above the known chess clocks have two totally separate, complete clock units and therefore it cannot be avoided that these units differ to a certain extent as far as accuracy is concerned, and this difference in accuracy may in some cases be decisive for the result of the game.

SUMMARY OF THE INVENTION

By means of the present invention a chess clock has been provided having two clock units which register the time with absolutely the same accuracy. Furthermore, the invention makes it possible to obtain a number of other substantial advantages compared to the known mechanical chess clocks.

The present invention provides an electrical or electronic chess clock comprising a pair of time measuring circuits each including a time display device and each being adapted to be operated by electrical pulses supplied thereto, and connecting means for connecting said time measuring circuits to a pulse source, said connecting means comprising a manually operatable electrical switching device for alternately ting said time measuring circuit to said pulse source. Due to the fact that the two time measuring circuits are driven by a common pulse source which may for example be the main or a special oscillator, the accuracy of the two time measuring circuits must necessarily be the same. By means of the electrical switching device the pulse source may alternately be connected to the time measuring circuits and that switching device may be operated by the players corresponding to the manner in which the rocking lever of a mechanical chess clock is operated.

The said electrical switching device may be of any suitable type. However, it preferably comprises an electronic switching circuit. In order to prevent that one and the same output pulse from the pulse source is supplied to both of the time measuring circuits the chess clock according to the invention may further comprise means permitting said switching device to switch from one of the time measuring circuits to the other only at time intervals between successive output pulses from said pulse source.

The chess clock according to the invention may further comprise two manually operatable electrical contacts each associated with a respective one of said time measuring circuits and adapted to create a switching initiating pulse when operated and passing it to said switching circuit, and means for rendering the second of two succeeding initiating pulses created by operation of one and the same of said contacts, ineffective, provided that no intervening initiating signal has been created by operation of the other of said contacts. Thus, a player who has operated one of said contacts in order to stop registration of time in the corresponding time measuring circuit when he has made a move, is unable to start registration of time in that time circuit again, for example by inadvertently operating the said contact a second time, before the opponent has made a move and operated the other of said contacts.

The time display devices of the time measuring circuits may be of any suitable type, for example a dial with hands. However, the display device is preferably a digital display device which may, for example, have three digits, two of which may indicate minutes, whereas the third may indicate hours. The clock according to the invention may comprise means for shifting the digital output of the time display when a first predetermined period of time, for example 59 minutes, has been registered on said display so as to cause said digits to indicate seconds for a second predetermined period of time, for example one minute. By means of three digits the time display device will then be able to display a total time of up to ten hours and even indicate seconds in critical periods, for example just before passing the hour. The chess clock may also comprise signalling means for generating a visual and/or auditive signal when the preset time of the game has expired. Alternatively or additionally the clock may comprise means for stopping registration of time when a predetermined or preset time period has been registered by one of the time measuring circuits. These features serve purposes similar to those of the "wing" in the known mechanical chess clock. However the digital display of seconds in critical periods, the use of signalling means to indicate termination of the time, and/or the use of means for automatically stopping a chess clock when the preset time of the game has expired make it possible for the player to obtain much more detailed and reliable information about the time left than possible by use of the known mechanical clocks. In case the prescribed duration of the chess game is less than ten minutes the chess clock may advantageously be provided with manually operatable shifting means for shifting the three digits of each display device to show hours and minutes. during the whole game instead of hours and minutes. This feature may for example be of interest when playing "blitz-chess" for which the maximum total time of thinking over is normally five minutes.

BRIEF DESCRIPTION OF THE DRAWINGS

The invention will now be further described with reference to the accompanying drawings, wherein.

DESCRIPTION OF PREFERRED EMBODIMENTS

Figure 1:
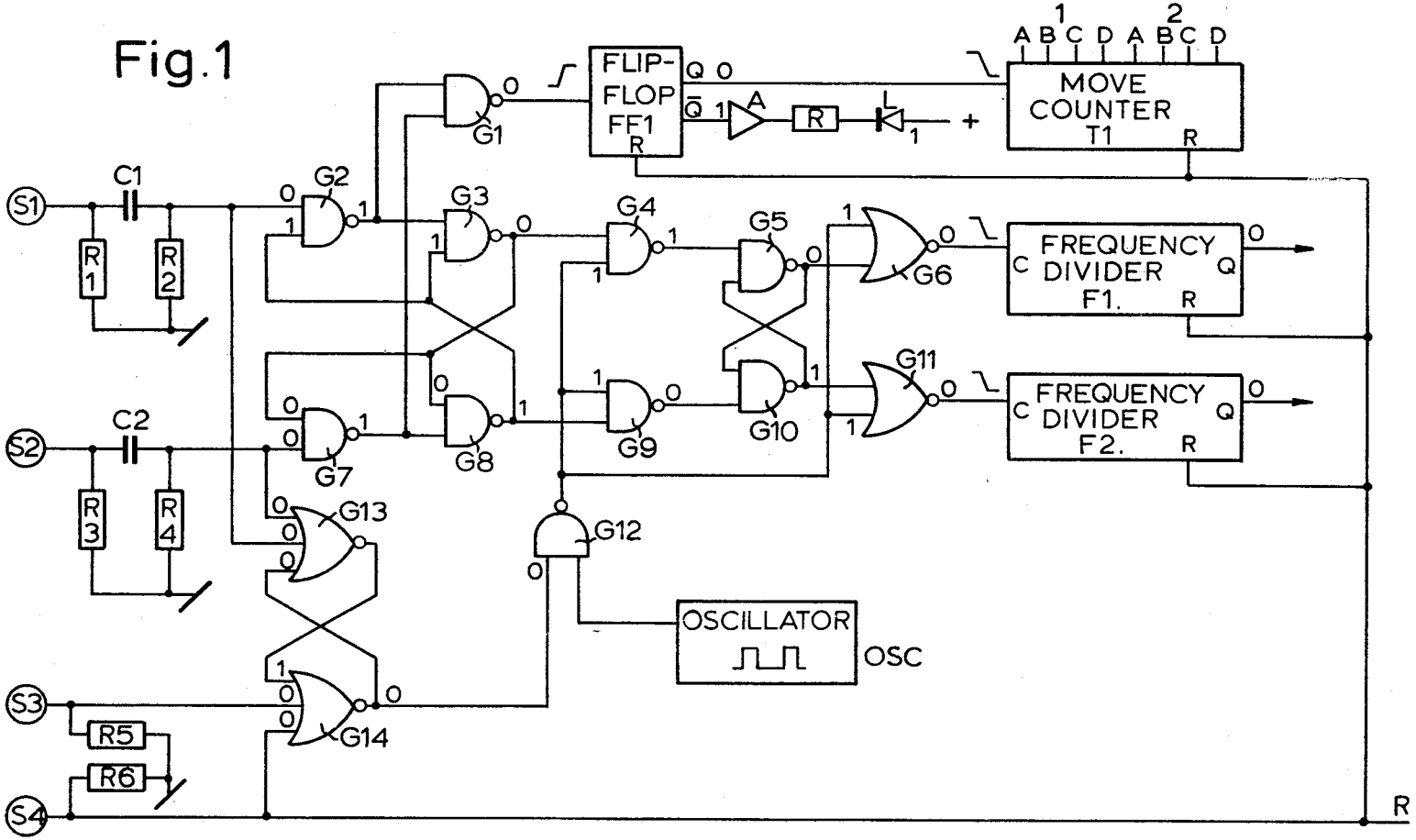
FIG. 1 is a block diagram of a switching unit of an embodiment of a chess clock according to the invention.
Figure 2:
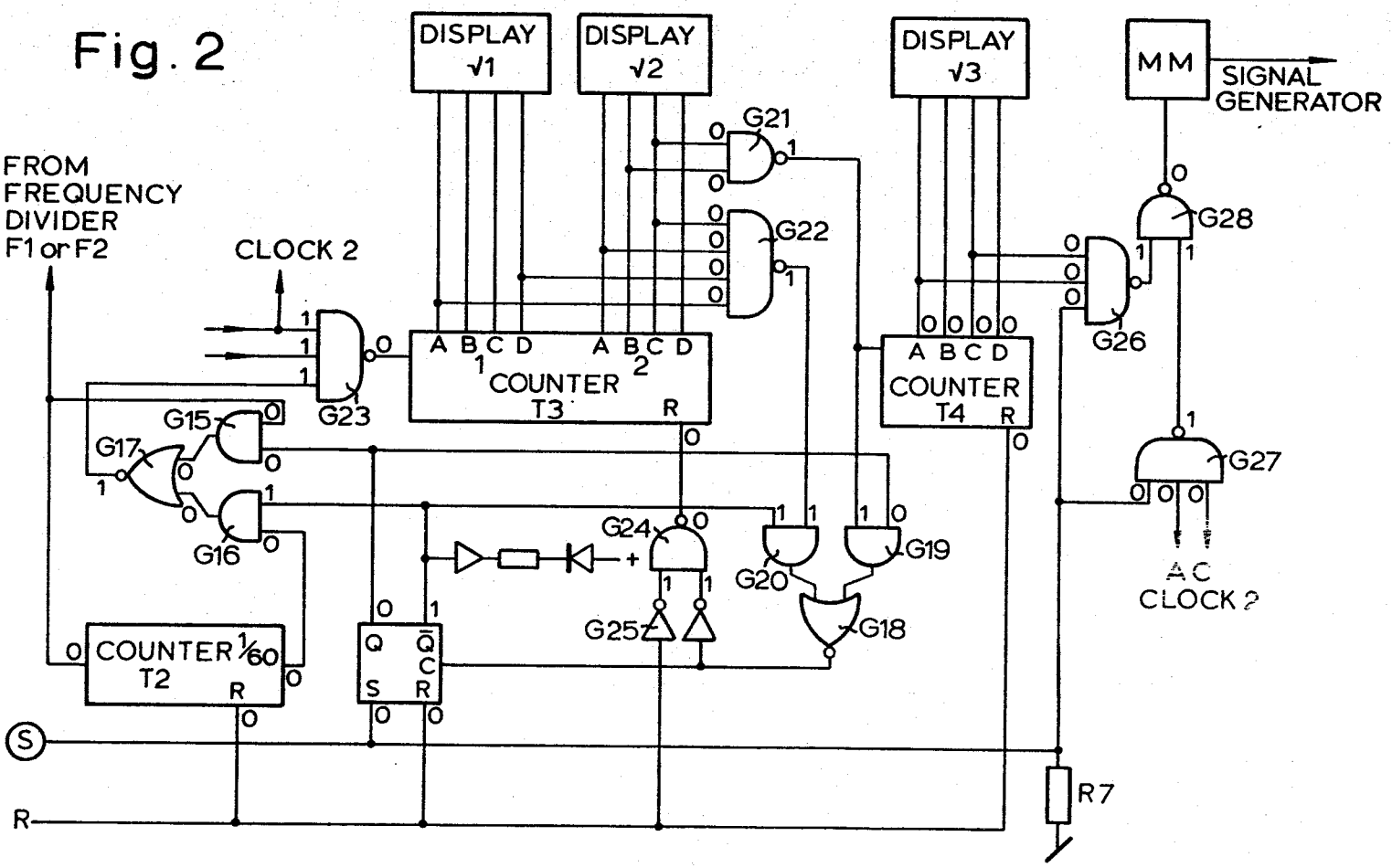
FIG. 2 is a block diagram of one of the time measuring circuits or clock circuits included in the chess clock of the invention.

The chess clock according to the invention comprises a switching unit as shown in FIG. 1 and two time measuring circuits or clock circuits as that shown in FIG. 2.

The circuits shown in FIGS. 1 and 2 comprise a number of gating devices or gates designated G1, G2, G3 up till G28, respectively. In the supposed starting condition of these circuits each of the in- and outputs of the various gates are at one of two different logical levels, namely a high level which is indicated by "1" in the drawings, and a low level which is indicated by "0".

The switching circuit shown in FIG. 1 includes two manually operateable contacts designated S1 and S2, respectively. These are the contacts which are operated by the players during the chess game to indicate that a move has been made. The switching circuit also includes a contact S3 by means of which the chess clock may be stopped without resetting the time display thereof to zero, and a contact S4 by means of which the time displays of both clock circuits may be reset to zero as will be further described below. The outputs of the contacts S3 and S4 are connected to ground through resistors R5 and R6, respectively. When any of the contacts S1 – S4 is operated or depressed its output becomes 1, i.e. a high logical level is established at the output. The starting condition of the switching unit or switching circuit as indicated in FIG. 1 may for example have been established by depression of the contact S2 and succeeding operation of the contact S4 for resetting the time displays of the chess clock to zero. In order to avoid contact rebound a circuit including resistors R1 and R2 and a capacity C1 is connected between the contact S1 and the remaining parts of the switching unit or circuit. Correspondingly, a circuit including resistors R3 and R4 and a capacity C2 is inserted between the contact S2 and the remaining parts of the switching circuit.

If the contact S2 is operated or depressed by one of the players the gate inputs which are connected to the capacity C2 will become 1 and thereafter again fall to 0 (determined by the time constant C2 – R4). The NOR-gates G13 and G14 are connected so as to establish a set-reset flip-flop which will change its state by operation of the contact S2, and thereby the NAND-gate G12 will be opened so that pulses from a pulse source or oscillator designated OSC in FIG. 1 may pass through that gate whereby negative pulses are provided to the NAND-gates G4 and G9, and also to the NOR-gates G6 and G11. As a result, positive pulses are passed through the gate G6 to a frequency divider F1. The output pulses from the frequency divider F1 are passed to a corresponding time measuring circuit or clock circuit as that shown in FIG. 2 as will be described more in detail in the following.

When the other player depresses the contact S1 both inputs of the NAND-gate G2 become 1, and the output of the gate becomes 0. As a result, the output of the NAND-gate G3 which is connected to the NAND-gate G8 as a set-reset flip-flop becomes 1 and, consequently, the output of the gate G8 becomes 0. As this output is connected to the other input of the gate G2 that gate will now be blocked for information from the contact S1, and simultaneously the output of the gate G2 will change to 1 and thereby prevent possible succeeding contact rebound. The output pulse from the gate G2 is transmitted to the NAND-gate G1, and due to the said arrangement the pulse will have steep flanges. The pulse form the gate G1 is transmitted to a flip-flop FF1 which thereby changes its state. The Q-output of the flip-flop is via an amplifier A and a resistor R connected to a visual indicator, such as a diode L1 which now becomes luminous to indicate that the contact S1 has been depressed (for example by white player).

In the condition now created where the output of the gate G3 is 1 and the output of the gate G8 is 0 the outputs of the NAND-gates G4 and G9 will be 0 and 1, respectively, provided that the output of the gate G12 is 1. Therefore, the NAND-gates G5 and G10 which are connected as a set-reset flip-flop will change their state so that the pulses from the pulse source or oscillator OSC is now transmitted to another frequency divider F2 and not to the frequency divider F1. It should be noted that when the output of the gate G12 is 0 information from the gates G3 and G8 is prevented from being transmitted to the flip-flop for changing the state of the same. The state of the flip-flop G5 – G10 determines whether pulses from the pulse source or oscillator OSC passes through the gate G6 to the frequency divider F1 or through the gate G11 to the frequency divider F2, and it should be understood that change of the state of the flip-flop is therefore possible only in the period of time between succeeding pulses. This prevents generation of false pulses and also renders it impossible for one and the same pulse to be transmitted to both of the frequency dividers F1 and F2.

As mentioned above the output of the gate G3 is 1 when the contact S1 has been depressed, and as that output is connected to the gate G7 the switching circuit is again ready to accept information from the contact S2 when the contact S1 has been operated. If the player operating the contact S2 has not released that contact after depression, but has retained it in its depressed position during and after the other player's operation of the contact S1 he will now have to release the contact S2 in order to be able to depress it again. In that case, however, the output of the gate G7 cannot be changed until the contact S2 has been opened for such a period of time that the load of the capacity C2 has been reduced to such an extent that closing of the contact S2 may provide a voltage at the input of the gate G7 exceeding its level of change. The necessary opening time for the contact S2 is determined by the capacity C2 and the resistors R3 and R4. Thus, opening of the contact S2 will not give rise to inadvertent switching of the clock and continued depression of the contact S2 by one of the players will not prevent the other player from shifting the clock by operation of the contact S1. Another depression of the contact S2 will bring the gates G1 – G11 back to their starting conditions indicated in FIG. 1 and simultaneously the flip-flop FF1 will shift and cause that a move counter T1 shown in FIG. 1 registers a move.

The outputs of the frequency dividers F1 and F2 are connected to each one of two almost identical time measuring circuits or clock circuits one of which is illustrated in FIG. 2. Both of the frequency dividers F1 and F2 preferably have the output frequency 1/f where f is the frequency of the oscillator OSC whereby the frequency divider to which pulses are supplied from the oscillator will transmit one pulse per second to the associated time measuring circuit.

The time measuring circuit or clock circuit shown in FIG. 2 comprises a number of counters designated T2, T3, and T4, respectively. The counter T3 which is a dual BCD up counter, is connected to digital display devices V1 and V2, and the counter T4 which is also a BCD up counter, is connected to a digital display device V3. The display devices V1–V3 are connected through corresponding decoders or a multiplex circuit not shown in the drawings. Pulses from the frequency dividers F1 and F2 associated with the time measuring circuits shown in FIG. 2 is supplied to the counter T2 and to an input of the AND-gate G15 having another input connected to the Q-output of a master-slave flip-flop FF2 so that pulses cannot pass through the gate G15. The $\overline{Q}$-output of the flip-flop is connected to one input of the AND-gate G16, and therefore output pulses from the minute counter T2 which outputs one pulse every minute, may pass through the gate G16, the NOR-gate G17, and the NAND-gate G23 to the input of the counter T3 which counts the number of output pulses received from the counter T2, i.e. the number of minutes, and that number is displayed by the digital display devices V1 and V2, ones being displayed by the display device V1 and tens being displayed by the display device V2. When the time measuring circuit illustrated in FIG. 1 has measured and registered 59 minutes the outputs of the counter T3 designated QA1 and QD1 as well as QA2 and QC2 will be 1. As each of these outputs is connected to the NAND-gate G22 the output of that gate which is connected to an input of the AND-gate G20 is 0. Because the other input of the gate G20 is connected to the output $\overline{Q}$ of the flip-flop FF2 both inputs of the gate G22 have been 1 to this very moment, and consequently, the output of the NOR-gate G18 which is connected to the gate G20 and the output of which is connected to the clock input C of the flip-flop FF2 and the input of the gate G25, has been 0.

When the output of the gate G18 now becomes 1 the counter T3 will be reset to zero through the gates G25 and G24 and the flip-flop FF2 will simultaneously change its state. As the Q-output of the flip-flop FF2 now becomes 1 both inputs of the AND-gate G19 will be 1, and consequently, the output of the gate G18 will be 0 which through the gates G25 and G24 causes opening of the counter T3. The output pulses from the associated frequency divider F1 or F2 may now pass through the gates G15, G17, and G23 directly to the clock input of the counter T3, whereas the passage is blocked for pulses from the counter T2. Because the $\overline{Q}$-input of the flip-flop FF2 has become 0 there will also be blocked for information from the gate G22. The minute counter T3 will now count seconds and display the number of seconds at the display devices V1 and V2. The fact that the counter T3 counts seconds may for example be indicated by means of a luminous diode L2 connected to the flip-flop FF2. When 60 seconds have lapsed the outputs QB2 and QC2 of the counter T3 will become 1 which has the result that the output of the gate G21 becomes 0 and thus causes that the hour counter T4 registers one hour which will be displayed by the display device V3. As the gate G19 changes simultaneously, the output of the gate G18 becomes 1 whereby the counter G3 again is reset to zero and the flip-flop F2 changes to the starting position and again opens for registration of minutes in the counter T3.

The input S of the flip-flop FF2 is connected to ground via a resistor R7. If the input S is connected to 1, for example by operation or depression of a contact S shown in FIG. 2, the outputs Q and $\overline{Q}$ become 1 and 0, respectively, and the state of the flip-flop will change and remain in that state. The counter T3 will then count and register seconds whereas the counter T4 will count and register minutes. The inputs of the gate G23 shown non-connected in FIG. 2 may be used either for separate setting or parallel setting of the time measuring circuits or clock circuits (for example 30 minutes).

FIG. 2 also shows a signalling circuit which is common to both of the time measuring circuits. This signalling circuit contains the NAND-gates G26, G27, and G28 and functions as follows: When the input S of the flip-flop FF2 is connected to 1 as mentioned above and to the outputs A and C of the counter T4 which are both connected to the gate G26 this will result in that the output of the gate G26 becomes 0 (for example after 5 minutes). When the other time measuring circuit or clock circuit (clock 2) not shown on the drawing is in a corresponding condition the output of the gate G27 will become 0, and as the output of the gate G26 as well as the output of the gate G27 are connected to the gate G28 the output of that gate will become 1, when one of the time measuring circuits registers that the preset time has lapsed (in this case 5 minutes). If the output of the gate G28 is connected to for example the contact S3 in FIG. 1 it is obtained that both time measuring circuits will stop registration of time, or the output of the gate G28 may be transmitted to a multivibrator MM as shown in FIG. 2. The output of the multivibrator may operate some kind of a signal generator or indicating device which indicates that the present time has lapsed. This arrangement is for example of importance when "blitz-chess" is being played. The chess clock may be reset to zero by operating the contact S4 which is connected to the counters T2, T3, and T4 through a conductor R.

Figure 3:
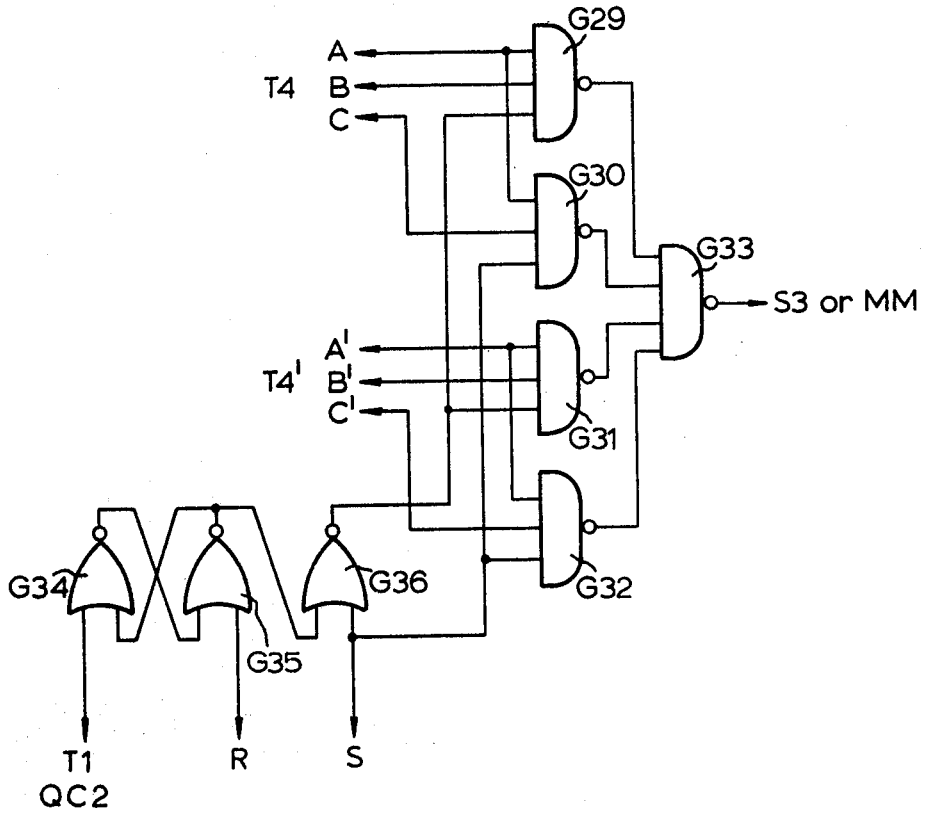
FIG. 3 is a modified embodiment of part of the circuit shown in FIG. 2.

FIG. 3 shows an alternative embodiment of the signalling circuit comprising the gates G26 – G28 and the multivibrator MM. In the embodiment shown in FIG. 3 the gates G26 – G28 in FIG. 2 have been replaced by a number of NAND-gates G29 – G33 and NOR-gates G34 – G36. By this arrangement the automatic stopping of the time measuring circuits or the clock circuits after a certain predetermined period of time may be made conditioned on whether a predetermined number of moves have not been made within that period of time (for example 40 moves within 2½ hours).

When the chess clock has been reset to zero the inputs and outputs of the gates G29 – G36 will obtain the logical levels indicated in FIG. 3. If before the start of the game both clock circuits are put 30 minutes forward, these clock circuits will automatically be stopped when one of them has registered 2½ hours, if not at least 40 moves have been made before that time. 1.

As shown in FIG. 3 the outputs A and B of the hour counter T4 (used as minute counter when "blitz-chess" is played) are connected to inputs of the gate G29, and the outputs A and C of the counter T4 are connected to inputs of the gate G30. Inputs of the gates G31 and G32 are correspondingly connected to corresponding outputs A'. B', and C' of the hour counter T4' in the other time measuring circuit or clock circuit (clock 2) as indicated in FIG. 3. When the outputs A and B of the counter T4 become 1 (when three hours have been registered by the counter T4) the output of the gate G29 becomes 0 which causes that the output of the gate G33 becomes 1. Provided that the output of the gate G33 is connected to the output of the contact S3 (FIG. 1) as indicated in FIG. 3 the chess clock (i.e. both of the time measuring circuits or clock circuits) will be stopped automatically provided that less than for example 40 moves have been registered by the move counter T1 (FIG. 1) as will now be further explained. The gates G34 and G35 are connected so as to form a set-reset flip-flop, and an input of the gate G34 is connected to an output QC2 of the move counter T1 as indicated in FIG. 3. The said output of the move counter T1 becomes 1 when 40 moves have been registered and the set-reset flip-flop G34 – G35 will then change its state whereby the output of the gate G35 becomes 1 and the output of the gate G36 consequently becomes 0. As the output of the gate G36 is connected to inputs of the gates G29 and G31, respectively, both of these gates will now become blocked for informations so that the chess clock will proceed to operate without stop. It should be understood that a similar function is obtained if the hour counter T4' is the first to register the predetermined time, for example three hours.

Inputs of the gates G30, G32, and G36 are connected to the contact S mentioned above in connection with the circuit illustrated in FIG. 2. If the contact S is operated after resetting the clock circuits to zero, the output of the contact S becomes 1. Thereby the gates G30 and G32 which have been closed during the operation previously described, will now be opened and simultaneously the output of the gate G36 becomes 0 whereby the gates G29 and G31 are closed. As explained above operation of the contact S causes that the counter T4 will count minutes, and when five minutes hve been counted the outputs A and C of the counter T4 which causes that the outputs of the gates G30 and G32 become 0 whereas the output of the gate G33 becomes 1, and the time measuring circuits or clock circuits will now stop.

The signalling circuit described above may be modified in several respects, but it seems to be common to all relevant modifications that the hour (or minute) counter T4 and T4' have some of their outputs determining the maximum period of time after which the chess clock should be stopped, connected to a common gate, for example the gate G33, which is shifted by that of the counters T4 and T4' which is the first to register the predetermined maximum period of time. As explained above, one of the outputs of the move counter T1 which is common to both time measuring circuits may give an information to the signalling or stopping circuit so as to neutralize its stopping function.

The circuit shown in FIG. 2 is one of several embodiments by means of which the total number of digits of the displays V1, V2, and V3 may be reduced to three for each time measuring circuit or clock circuit. By means of these three digits as well hours, as minutes and even seconds may be displayed.

It should be understood that several other modifications and changes may be made within the scope of the invention defined by the following claims.

I claim:

1. An electrical chess clock comprising a pair of time measuring circuits each including a digital time display device having two digits normally indicating minutes and each time measuring circuit being adapted to be operated by electrical pulses supplied thereto, and connecting means for connecting said time measuring circuits to a pulse source, said connecting means comprising a manually operatable electrical switching device for alternately connecting said time measuring circuits to said pulse source, said time measuring circuits including means for shifting the digital output of the time display when a first predetermined period of time has been registered on said display so as to cause said two digits to indicate seconds for a second predetermined period of time.

2. An electrical chess clock according to claim 1, wherein said switching device comprises an electronic switching circuit.

3. An electrical chess clock according to claim 2, further comprising means permitting said switching device to switch from one of the time measuring circuits to the other only in the time intervals between successive output pulses from said pulse source.

4. An electrical chess clock according to claim 3, further comprising two manually operatable electrical contacts each associated with a respective one of said time measuring circuits and adapted to create a switching initiating pulse when operated and to pass it to said switching circuit, and means for rendering the second of two succeeding initiating pulses created by operation of one and the same of said contacts ineffective provided that no intervening initiating signal has been created by operation of the other of said contacts.

5. An electrical chess clock according to claim 1, wherein said first predetermined period of time is 59 minutes, and said second predetermined period of time is one minute.

6. An electrical chess clock according to claim 1, wherein said digital time display device further comprises one digit for indicating hours in said first period of time, said shifting means being adapted to cause said one digit to indicate minutes in said second predetermined period of time.

7. An electrical chess clock according to claim 4, further comprising means for stopping registration of time when a third predetermined time period has been registered by one of said time measuring circuits.

8. An electrical chess clock according to claim 7, further comprising a move counting device for counting the number of effective switching initiating pulses created by operation of one of said contacts.

9. An electrical chess clock according to claim 8, further comprising means for rendering said stopping means ineffective if a third predetermined minimum number of moves has been registered by the move counter when said predetermined time period is being registered.

* * * * *